US012467112B2

(12) United States Patent
Zhang et al.

(10) Patent No.: US 12,467,112 B2
(45) Date of Patent: Nov. 11, 2025

(54) LOW-CARBON LOW-COST ULTRA-HIGH-STRENGTH MULTIPHASE STEEL PLATE/STEEL STRIP AND MANUFACTURING METHOD THEREFOR

(71) Applicant: BAOSHAN IRON & STEEL CO., LTD., Shanghai (CN)

(72) Inventors: Hanlong Zhang, Shanghai (CN); Yiqiang Sun, Shanghai (CN); Xinping Mao, Shanghai (CN); Yulong Zhang, Shanghai (CN); Cheng Wang, Shanghai (CN); Xinyan Jin, Shanghai (CN); Li Wang, Shanghai (CN); Shuize Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 672 days.

(21) Appl. No.: 17/789,089

(22) PCT Filed: Dec. 30, 2020

(86) PCT No.: PCT/CN2020/141301
§ 371 (c)(1),
(2) Date: Jun. 24, 2022

(87) PCT Pub. No.: WO2021/136352
PCT Pub. Date: Jul. 8, 2021

(65) Prior Publication Data

US 2023/0052592 A1 Feb. 16, 2023

(30) Foreign Application Priority Data

Dec. 31, 2019 (CN) ..... 201911415233.7

(51) Int. Cl.
*C21D 9/52* (2006.01)
*C21D 8/02* (2006.01)
(Continued)

(52) U.S. Cl.
CPC ..... *C21D 9/52* (2013.01); *C21D 8/0226* (2013.01); *C21D 8/0273* (2013.01);
(Continued)

(58) Field of Classification Search
CPC ..... C21D 9/52; C21D 8/0226; C21D 8/0273; C21D 8/0278; C21D 2211/002;
(Continued)

(56) References Cited

U.S. PATENT DOCUMENTS

2014/0230970 A1* 8/2014 Perlade ..... C21D 8/0405 148/333
2014/0261914 A1 9/2014 Jamwal et al.

FOREIGN PATENT DOCUMENTS

CN 101285156 A 10/2008
CN 102251170 A 11/2011
(Continued)

OTHER PUBLICATIONS

International Search Report for PCT/CN2020/141301 dated Mar. 30, 2021.
(Continued)

*Primary Examiner* — Danielle M. Carda
(74) *Attorney, Agent, or Firm* — Smith Tempel Blaha LLC; Lei Fang, Esq.

(57) ABSTRACT

Disclosed are a low-cost ultra-high-strength multiphase steel plate/steel strip and its manufacturing method. Said steel plate/steel strip comprises the following components in percentage by weight: 0.03 to 0.07% of C, 0.1 to 0.5% of Si, 1.3 to 1.9% of Mn, less than or equal to 0.02% of P, less than or equal to 0.01% of S, 0.01 to 0.05% of Al, 0.2 to 0.5% of Cr, 0.07 to 0.14% of Ti, less than 0.03% of (Ni+Nb+Mo+V), and the balance being Fe and other inevitable impurities; and Mn+1.5Cr+5 (Ti+Al+Cu)+10(Mo+Ni)+20(Nb+V)<3.0; Mn+2Cr+4Ti+4Nb+4V+4Mo—Si/3+2C≤3.0. The steel
(Continued)

plate is mainly used for the manufacturing of automotive chassis and suspension system parts.

19 Claims, 2 Drawing Sheets

(51) Int. Cl.

| | |
|---|---|
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |

(52) U.S. Cl.
CPC ..... *C21D 8/0278* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/58* (2013.01); *C21D 2211/002* (2013.01); *C21D 2211/005* (2013.01)

(58) Field of Classification Search
CPC .. C21D 2211/005; C21D 6/002; C21D 6/005; C21D 6/02; C21D 8/0205; C21D 9/46; C21D 2211/004; C21D 1/02; C21D 8/021; C21D 8/0263; C21D 1/26; C22C 38/02; C22C 38/06; C22C 38/44; C22C 38/46; C22C 38/48; C22C 38/50; C22C 38/58; C22C 38/22; C22C 38/24; C22C 38/04; C22C 38/26; C22C 38/28; C22C 38/38; C22C 38/40; C22C 38/002; B32B 15/01; B32B 15/013; C23C 2/06; C23C 2/0222; C23C 2/024; B21C 47/02
USPC ..... 420/119
See application file for complete search history.

(56) References Cited

FOREIGN PATENT DOCUMENTS

| | | | |
|---|---|---|---|
| CN | 103602895 | A | 2/2014 |
| CN | 104513930 | A | 4/2015 |
| CN | 105821301 | A | 8/2016 |
| CN | 107723608 | A | 2/2018 |
| CN | 108048734 | A | 5/2018 |
| JP | 2007070649 | A | 3/2007 |
| JP | 2014514443 | A | 6/2014 |
| JP | 2017025397 | A | 2/2017 |
| KR | 20130071705 | A | 7/2013 |
| KR | 20130110638 | A | 10/2013 |
| WO | 2011135997 | A | 11/2011 |
| WO | 2019130713 | A1 | 12/2019 |

OTHER PUBLICATIONS

International Written Opinion for PCT/CN2020/141301 dated Mar. 30, 2021.
The extended European search report for EP App No. 20911271.3 (BI82K92) dated May 12, 2023.
JP Office Action for App No. 2022-538801 dated Aug. 1, 2023.

* cited by examiner

LOW-CARBON LOW-COST ULTRA-HIGH-STRENGTH MULTIPHASE STEEL PLATE/STEEL STRIP AND MANUFACTURING METHOD THEREFOR

CROSS-REFERENCE TO RELATED APPLICATIONS

This application is a 371 U.S. National Phase of PCT International Application No. PCT/CN2020/141301 filed on Dec. 30, 2020, which claims benefit and priority to Chinese patent application No. CN201911415233.7 filed on Dec. 31, 2019, the contents of each of the above listed applications are incorporated by reference herein in their entiries.

TECHNICAL FIELD

The present disclosure belongs to metal material field, in particular relates to a low-carbon low-cost ultra-high strength multiphase steel plate/steel strip and a manufacturing method therefor, which is mainly used in the manufacture of parts and components products for automotive chassis and suspension system.

BACKGROUND ART

The "lightweighting" of automobiles can directly reduce emissions and reduce fuel consumption, which is the goal of today's automobile manufacturing industry. One important measure of "lightweighting" of automobiles is the use of high-strength and ultra-high-strength steel plates instead of low-strength steel plates. At present, the concept of "lightweighting" is further applied to automotive chassis and suspension systems, and automotive chassis materials are also required to adopt high-strength steel to achieve "lightweighting" with increasingly stringent environmental requirements and market demands.

However, in addition to higher strength of the steel plate, it is also required for the structural parts of the automobile chassis and suspension system that the steel plates have a relative high yield tensile strength ratio (that is, the ratio of yield strength to tensile strength, hereinafter referred to the yield ratio), good elongation, good hole-expansion performance and good bending performance Unlike some autobody parts that need to absorb collision energy or avoid rigid collision damage to walkers through certain plastic deformations during collisions, it is often required for chassis and suspension systems that the material does not have any plastic deformation, so the yield ratio of the material needs to be extremely high. In addition, it is well known that the fatigue limit of a material is often proportional to its yield strength. Thus, in the case of the same tensile strength level, the material having higher yield strength means that the material has a higher fatigue limit. Therefore, for the parts of chassis and suspension system, one of the goals pursued is to have higher yield strength or higher yield ratio at the same tensile strength level.

In addition, the parts of automotive chassis and suspension system often have a complex structure (as shown in FIG. 1) and the procedures such as flanging, hole expanding, bending, stretching and the like coexist, so the requirement for the forming performance of the material is extremely high. It is required that not only the steel has a high elongation, a larger hole expansion ratio, but also the steel plate has excellent bending performance. However, it is known in the art that the strength of the steel plate is mutually restrictive to three performance indicators, i.e.

yield ratio, elongation and hole expansion ratio, because it requires phase components with high strength and hardness in the steel (such as martensite and bainite) to ensure the strength, softer phase components (such as ferrite) to ensure plasticity and elongation, and enough uniform structure to improve the bending performance, and also requires the difference in hardness between the soft phase and the hard phase is as small as possible to ensure high yield ratio and high hole expansion performance.

In addition to the above-mentioned stringent performance requirements, the preparation of parts for automotive chassis and suspension systems also requires materials with good surface quality, coat-ability, and normal and uniform color, as well as low carbon equivalent levels to ensure the weldability of the parts, so the composition is commonly designed to comprise low-carbon (carbon content less than 0.1%). Under this composition system, in order to obtain steel with high strength and high yield ratio, high elongation, high hole-expansion and high bending properties, and meet the manufacture requirement of automotive chassis and suspension system parts having a complicated shape, high quality and high service performance, a multiphase steel with bainite as the main body and ferrite as the supplement is usually selected and precipitation reinforcement is achieved by adding a large amount of alloying elements, especially niobium, molybdenum, vanadium, nickel, aluminum and other precious alloying elements, thereby improving ferrite strength and ensuring ferrite plasticity, thereby improving the yield ratio and ensure that steel has a high elongation and hole expansion ratio.

For example, Chinese patent publication CN109055657A discloses an ultra-low carbon high strength multiphase steel plate, which has a yield strength of ≥690 MPa and a yield ratio of 0.89-0.92 by adding a large amount of niobium, molybdenum, nickel and other precious metal elements but it does not consider the hole expansion performance of the steel plate. Chinese patent publication CN101906567A also discloses a high strength hot rolled steel plate, which has a tensile strength of higher than 780 MPa and a hole expansion ratio (the original hole is punched) of 40% or higher by adding a large amount of niobium, molybdenum, nickel and other precious metal elements.

Nonetheless, with the increasingly fierce internal competition in the steel industry and automotive industry, this kind of steel with the addition of a large amount of alloying elements, especially precious alloying elements such as molybdenum, vanadium and niobium, etc., has greatly increased the cost pressure of the entire automotive industry chain. Therefore, there is an urgent need in the market of a steel plate having excellent service and comprehensive forming performance with no or almost no addition of precious alloying elements (that is, low cost), and having high strength, high yield ratio, high elongation, high hole expansion ratio and high bending performance.

However, once precious alloying elements such as molybdenum, vanadium, and niobium, etc. are not added, it is difficult for low-cost multiphase steels to achieve high strength levels (such as a tensile strength of 800 MPa). For example, Chinese patent publication CN103667948A discloses a multiphase steel free of niobium, vanadium, nickel, molybdenum and other precious metal microalloying elements and the manufacturing method therefor. Although the multiphase steel designed in the patent application has a lower alloy cost and better hole-expansion performance, its strength is lower. The steel only has a yield strength of no higher than 520 MPa and a tensile strength of no higher than 725 MPa in the working examples. Therefore, it can only be designed to manufacture automobile wheels, and cannot meet the requirements of automotive chassis parts for the strength of multiphase steel product parts.

In order to solve the problem of insufficient strength of low-cost multiphase steel, one of the main methods is to add a large amount of relatively cheap alloying elements such as manganese, chromium and titanium instead of precious alloying elements such as molybdenum, vanadium and niobium, etc., and to improve the strength of multiphase steel through phase transformation strengthening, solid solution strengthening and second-phase strengthening. For example, Chinese patent publication CN102732790A discloses an ultra-low carbon bainite steel plate having a tensile strength of higher than 770 MPa and a manufacturing method therefor. Although the steel plate does not comprise niobium, molybdenum, vanadium and other precious metal microalloy elements, it still comprises 3.0%-4.5% of manganese, still leading to high cost. And the hole-expansion and bending properties of multiphase steel are not considered in this patent application. For example, Chinese patent publication CN101285156A discloses a bainite steel produced by using thin slab continuous casting and rolling technology. Although a high strength bainite steel with no niobium, molybdenum, vanadium and other precious metal microalloy elements and having high strength, high yield ratio, high elongation and certain bending performance is designed and manufactured by thin slab continuous casting and rolling technology in the patent, due to the addition of a large amount of chromium, manganese, titanium and other elements, the production and manufacturing cost of its products is still high, and the product bending performance is common. The hole-expansion performance is still not considered. In fact, manganese and chromium elements are very easy to form segregation in the steel plate, resulting in differences between local composition and phase composition, resulting in deterioration of the hole-expansion ratio and bending performance of the steel plate, while manganese elements are easy to cause coarse columnar crystal in the slab during continuous casting, and the coarse columnar crystal will have a genetic impact on the hot-rolled and cold-rolled structure of the subsequent steel plate, which in turn affects the uniformity of the steel plate structure and adversely affects the hole expansion performance and bending performance.

Another preparation method of low-cost high-strength multiphase steel is to increase the strength of multiphase steel by adding a large amount of silicon element through solid solution strengthening effect. For example, Chinese patent publication CN1756853A discloses a high strength hot-rolled multiphase steel comprising ferrite, bainite/martensite and a second phase composition and a manufacture method therefor. A large amount of silicon element (up to 1.5%) is added in this patent to guarantee the ultra-high strength of the multiphase steel, thereby reducing the amount of other alloying elements. However, excessively high content of silicon element will lead to serious red iron oxide scale on the surface of hot-rolled steel plate/steel strip, which will directly cause serious color difference on the surface of the finished steel plate/steel strip, and directly affect its surface quality and aesthetics as an automotive structural part. According to the known arts: Yang Yu, Chang Wang, Lin Wang, et al., Research on defects of red iron scale on Si-containing steel based on high temperature oxidation characteristics [J], Rolling Steel, 2016, 33(2): 10-15; Yang Yu, Chang Wang, Lin Wang, et al., Research on defects of red iron scale on Si-containing steel based on high temperature oxidation characteristics [J], Rolling Steel, 2016, 33(2): 10-15; Chang Wang, Yang Yu, Lin Wang, et al., Research on the effect of Si element on the interface microstructure of oxide scale forming in the heating furnace [J], Rolling Steel, 2016, 33(5): 6-10, when the silicon content in the steel is high, defects such as red scales can be formed and thus the surface quality of the steel is reduced. It is found that the automotive steel comprising 0.5% silicon has an equally spaced strip of iron scale on the surface of the strip steel, and the proportion of red iron scale defects on the surface of the strip steel is about 30%. Therefore, the ultra-high strength multiphase steel designed and manufactured by adopting the high silicon element solution is not suitable for the automotive industry.

Therefore, for such low-carbon multiphase steels with tensile strength up to 800 MPa (hereinafter referred to as low-carbon high-strength multiphase steels) used in the manufacture of automotive chassis and suspension system parts, the existing technology cannot solve the contradiction between its low-cost design and high comprehensive service performance Even if the existing low-cost design is adopted, it is impossible to provide excellent strength, yield ratio, hole-expansion, and bending properties at the same time. Thus, the long-standing challenge in the steel industry is how to obtain multiphase steel plates/steel strips with low cost and high strength, high hole expansion characteristics to meet the production and manufacturing requirement of auto parts.

SUMMARY

One object of the present disclosure is to provide a low cost ultra-high strength multiphase steel plate/steel strip and a manufacturing method therefor, wherein the steel plate has a tensile strength of ≥780 MPa, a yield strength of ≥680 MPa, an elongation of ≥15%, a yield ratio of ≥0.9, a hole expansion ratio which satisfies: if the initial hole is a punched hole, the hole expansion ratio is ≥85%; if the initial hole is a reamed hole, the hole expansion ratio is ≥115%, and a bending performance which meets that no cracking occurs when the bending angle diameter of the 180° bending experiment is equal to 0.5 plate thickness (d=0.5a). The low cost ultra-high strength multiphase steel plate/steel strip is mainly used in the manufacture of automotive chassis and suspension system parts.

To achieve the above object, the technical solution of the present disclosure is as follows:

A low cost ultra-high strength multiphase steel plate/steel strip comprises the following chemical elements in weight percentages: C: 0.03-0.07%, Si: 0.1-0.5%, Mn: 1.3-1.9%, P≤0.02%, S≤0.01%, Al: 0.01-0.05%, Cr: 0.2-0.5%, and further comprises Ti: 0.07-0.14%, (Ni+Nb+Mo+V)<0.03%, and a balance of Fe and unavoidable impurities; at the same time, it is required to satisfy:

$$[Mn+1.5Cr+5(Ti+Al+Cu)+10(Mo+Ni)+20(Nb+V)]<3.0;$$

$$(Mn+2Cr+4Ti+4Nb+4V+4Mo—Si/3+2C)\leq 3.0.$$

Preferably, the steel plate/steel strip comprises the chemical element of C: 0.04-0.06%, in weight percentage.

Preferably, the steel plate/steel strip comprises the chemical element of Si: 0.1-0.27%, in weight percentage.

Preferably, the steel plate/steel strip comprises the chemical element of Mn: 1.45-1.75%, in weight percentage.

Preferably, the steel plate/steel strip comprises the chemical element of Cr: 0.35-0.50%, in weight percentage.

Preferably, the steel plate/steel strip does not comprise V, Mo and Ni, and the content of Nb is ≤0.03%.

The microstructure of the steel plate/steel strip of the present disclosure contains ferrite, lower bainite, and further contains carbide precipitation phase, inclusion phase and/or trace martensite phase, wherein the content of ferrite is ≤70%, and the content of ferrite+lower bainite is ≥90%.

Preferably, in the slab casting structure of the steel plate/steel strip, the proportion of columnar crystals is ≤10%, or the thickness of the columnar crystal region is <40 mm.

Preferably, in the microstructure of the finished steel plate/steel strip, the average diameter of ferrite grains is <6 μm, or a grain size ASTM rating is >11.8.

Preferably, the microstructure of the finished steel plate/steel strip contains TiN particles, and a single particle has the longest side length of <10 μm or an area of <50 $\mu m^2$. Preferably, the longest side length of a single TiN particle is <8 μm.

According to the above solution, the steel plate/steel strip has a tensile strength of ≥780 MPa, a yield strength of ≥680 MPa, and a hole expansion ratio performance index: if the original hole is a punched hole, the hole expansion ratio is ≥85%; if the original hole is a reamed hole, the hole expansion ratio is ≥115%; 180° bending is qualified at d=0.5a.

Preferably, according to the above solution, the steel plate/steel strip has a tensile strength of ≥800 MPa, a yield strength of ≥710 MPa, and a hole expansion ratio performance index: if the original hole is a punched hole, the hole expansion ratio is ≥95%; if the original hole is a reamed hole, the hole expansion ratio is ≥120%; 180° bending is qualified at d=0.5a.

Preferably, the steel plate/steel strip according to the above solution has a yield ratio of ≥0.9.

The composition of the steel according to the present disclosure is designed as follows:

Carbon (C): Carbon directly affects the strength, weldability, formability and manufacturability of thin slab continuous casting of steel plates/steel strips. The higher the carbon content, the more conducive it is to increase the strength of the steel plate. If the carbon content is lower than 0.03%, the strength of the steel plate/steel strip cannot meet the target requirements; if the carbon content is higher than 0.07%, it is easy to cause excessively high strength of the steel plate/steel strip, resulting in unacceptable hole expansion ratio. Thus, the carbon content according to the present disclosure is controlled to be from 0.03 to 0.07%.

Silicon (Si): Silicon has a certain solid solution strengthening effect. The higher the Si content, the more conducive it is to improve the yield strength of the steel plate/steel strip. At the same time, silicon also has the effect of inhibiting carbide precipitation, and can form a bainite structure with no carbide precipitates by adding silicon elements. But when the silicon content is higher than 0.5%, it is prone to generate serious red iron oxide scale on the surface of hot-rolled steel plate/steel strip, which not only worsens the surface quality of the steel plate/steel strip, but also damages the platability of the steel plate/steel strip, which is not conducive to the production of hot-dip galvanized steel plate/steel strip. Therefore, the silicon content according to the present disclosure is controlled to be from 0.1 to 0.5%.

Manganese (Mn): since manganese can effectively enhance the strength of steel plate/steel strip, and the cost is relatively low relative to other alloying elements, manganese is used as the principal added element in the present disclosure. However, when the manganese content is higher than 1.90%, not only the proportion or thickness of the columnar crystals in the slab cast structure will increase significantly, which will have a serious adverse effect on the control of the uniformity of the finished product structure in the future, the increase in the Mn content will also lead to an increase in the martensite content in the final finished structure, which will damage the hole expansion performance; when the manganese content is less than 1.40%, the strength of the steel plate/steel strip is insufficient. Therefore, the manganese content according to the present disclosure is controlled to be from 1.30 to 1.90%.

Aluminum (Al): Aluminum is added as the main deoxidizer in the steelmaking process. But when the aluminum content is less than 0.01%, the de-oxidation effect is insufficient; when the aluminum content exceeds 0.05%, the viscosity of the molten steel is affected, which may cause nodules in the water nozzle and damage the welding performance of the steel plate/steel strip. Therefore, the aluminum content according to the present disclosure is controlled to be from 0.01 to 0.05%.

Chromium (Cr): Chromium is conducive to expanding the bainite phase region, ensuring that the bainite structure can be obtained in cooling the steel plate/steel strip after rolling, which is conducive to improving the strength and the hole expansion ratio. However, when the added amount exceeds 0.5%, the strength increase is no longer significant, and it is not conducive to the weldability of the steel plate/steel strip, resulting in a significant increase in the proportion or thickness of the columnar crystals in the slab cast structure, and also leads to the enrichment of chromium elements on the surface of the steel plate, thus affecting the structure uniformity of the final product. However, when the content is less than 0.2%, the expansion of the bainite phase region is not significant. Therefore, the chromium content according to the present disclosure is controlled to be from 0.2 to 0.5%.

Titanium (Ti): Titanium is the main alloying element in the multiphase steel of the present disclosure, which enhances the strength of the multiphase steel by solid solution strengthening and second phase strengthening after the formation of a fine carbide. When the microalloy content is lower than 0.07%, the strength of the steel plate/steel strip is insufficient; when the microalloy content is higher than 0.14%, it increases the cost on the one hand, and it is easy to form carbide center segregation on the other hand, which is not conducive to the hole-expansion performance.

Niobium, vanadium, molybdenum and nickel (Nb, V, Mo, Ni): The addition of niobium, vanadium, molybdenum and nickel can also produce solid solution strengthening and second-phase strengthening, thereby increasing the strength of multiphase steels. In addition, the inclusion of these precious metal microalloy elements can also achieve the effect of refining grains, which is conducive to the hole expansion ratio of multiphase steel. However, compared to titanium, alloys of niobium, vanadium, molybdenum and nickel are extremely expensive. Although these microalloy elements may be added as an optional element to steel, it is not recommended to add niobium, vanadium, molybdenum and nickel taking low cost into consideration, i.e., Nb+V+Mo+Ni<0.03%.

The upper limit of impurity elements in steel is controlled at P≤0.02%, S≤0.01%, and the purer the steel, the better the effect.

The microstructure of the steel plate/steel strip of the present disclosure is a microstructure of ferrite+lower bainite, wherein the ferrite content is ≤70%. The content of ferrite+lower bainite is ≥90%. If the ferrite structure is higher than 70%, the steel plate/steel strip will not be able to provide the required strength; if the ferrite+lower bainite content is less than 90%, the hole expansion performance of the steel plate/steel strip will not meet the requirements. The microstructure of the steel plate/steel strip of the present disclosure may also contain a carbide precipitation phase, a inclusion phase and/or a trace martensite phase, wherein the content of the carbide precipitation phase is typically 5% or less, the content of the inclusion phase is typically 0.01% or less (occasionally found in the visible field), the content of the martensite phase is typically 0.5% or less. The inclusions may be common inclusions in steels such as MnS, TiN and AlN.

In the microstructure of the steel plate/steel strip according to the present disclosure, the average diameter of the ferrite grain is <6 μm, or the grain size ASTM rating is >12.3. If the average grain diameter is not less than 6 μm or the grain size rating is not greater than 12.3, the steel plate/steel strip will not be able to provide the required strength.

The microstructure of the steel plate/steel strip of the present disclosure contains TiN particles, of which the longest side length of a single particle is <10 μm. If the longest side length of a single particle is not less than 10 μm, it will cause the steel plate/steel strip to fail to provide the required hole expansion performance.

In addition, based on the percentage of each element, the measurement relationship between the above alloying elements and carbon elements should also meet the following formula:

(1) $[Mn+1.5Cr+5(Ti+Al+Cu)+10(Mo+Ni)+20(Nb+V)]<3.0$, to ensure that the steel plate/steel strip has low alloy cost;

(2) $(Mn+2Cr+4Ti+4Nb+4V+4Mo-0.5Si+5C)\leq 3.0$, to ensure that a certain amount of carbide particles can be precipitated in the microstructure of the steel plate/steel strip, without the reduction of the hole expansion ratio caused by excessive, too coarse or too much carbide precipitation, thereby guaranteeing that the steel plate/steel strip has both high strength and hole expansion properties.

The manufacturing method for the ultra-low carbon low cost ultra-high strength multiphase steel plate/steel strip according to the present disclosure comprises the following steps:

1) Smelting, continuous casting wherein the above chemical composition is smelt and cast into a casting slab by continuous casting, wherein a cooling rate of the slab is ≥5° C./s during continuous casting;

2) Hot rolling, cooling after rolling wherein the slab enters the furnace at a temperature of not less than 700° C., and the casting slab is heated at a heating temperature of 1100-1250° C.; wherein each reduction rate for the first and second pass of hot rolling is ≥55%, and a final rolling temperature of finish rolling is 850-950° C.;

3) Cooling after rolling, coiling wherein water cooling is performed after rolling, and the coiling temperature is 550-630° C.;

4) Pickling.

Further, after the step 3) pickling, the method further comprises the hot galvanizing annealing process to obtain the finished hot-rolled hot-dip galvanized steel plate.

In the above step 1), the slab cooling rate during continuous casting will affect the grain size in the final structure of the steel plate/steel strip, the size of the inclusions formed in the liquid phase and the proportion of columnar crystals in the slab structure. If the cooling rate is lower than 5° C./s, on the one hand, the thickness or proportion of the columnar crystals in the slab will be higher than the design requirements, so that it is easy to form a banded structure in the subsequent finished product structure, which affects the bending properties of the steel plate/steel strip; on the other hand, the decrease of slab cooling rate during continuous casting will result in that the grain size in the final structure cannot meet the design requirement, and will lead to the coarse size of the inclusions (typically such as TiN) generated in the liquid phase in the steel, which is adverse to hole expansion and bending performance.

In the above step 2), the minimum temperature before the slab enters the heating furnace will affect the final properties of the product. When the minimum temperature before the slab enters the heating furnace is less than 700° C., titanium carbide will precipitate in the slab in large quantities, and in the subsequent reheating process, the titanium carbide that has been precipitated in the slab cannot be completely redissolved into the slab, resulting in less sosoloid titanium and titanium carbide in the matrix after hot rolling and insufficient product strength. When the final rolling temperature of finish rolling is less than 850° C., there will be ferrite precipitation before finish rolling, resulting in a low bainite content in the final structure, so that the steel plate/steel strip cannot reach the set strength. However, considering the slab heating temperature, the final rolling temperature of finish rolling should not exceed 950° C. In addition, in the above step 2), in order to ensure that the steel plate/steel strip has a fine and highly uniform structure, each reduction rate for the first and second pass of hot rolling is ≥55%; when the reduction rate is insufficient, it is impossible to obtain fine and uniform structure, resulting in insufficient strength of the steel plate/steel strip, and the bending performance cannot meet the design requirements. Not only that, the high reduction rate in the above step 2) must be cooperated with the high cooling rate of the slab during continuous casting in step 1). If the cooling rate of continuous casting cannot reach 5° C./s or more, the inclusions (mainly TiN) generated in the liquid phase in the slab will be too large; at this time, if a large reduction rate of ≥55% is used in step 2), it will lead to coarse TiN cracking, as shown in FIG. 1, thus becoming the source of cracks inside the steel plate/steel strip and resulting in the deterioration of the hole expansion and bending properties of the steel plate/steel strip. However, if the cooling rate of continuous casting can reach 5° C./s or more, the inclusions (mainly TiN) generated in the liquid phase in the slab are small in size, as shown in FIG. 2, and will not break at the large hot rolling reduction rate in step 2), so that it does not adversely affect the hole expansion and bending properties of the steel plate/steel strip.

In the above step 3), the coiling temperature is one of the most critical process parameters to obtain high strength and high hole-expansion ratio. When the coiling temperature is higher than 640° C., due to the strong precipitation and coarsening of alloy carbides, it has a negative effect on the hole expansion ratio of the steel plate. On the other hand, when the coiling temperature is less than 550° C., the precipitation of carbides will be seriously inhibited, resulting in that the strength of the steel plate cannot meet the set requirements. Therefore, the coiling temperature in the present disclosure is limited to 550-630° C.

After verifying, the performance of the ultra-high-strength hot-rolled steel plate/steel strip according to the present disclosure satisfies the following indices:

1. Mechanical properties at room temperature:

A tensile strength of ≥780 MPa, preferably ≥800 MPa; a yield strength of ≥680 MPa, preferably ≥710 MPa; a yield ratio of ≥0.9. In some embodiments, the tensile strength is 780-900 MPa and the yield strength is 680-830 MPa.

2. Elongation at break:

A50 of ≥15% or A5 of ≥19%.

3. Hole expansion ratio performance

If the original hole is a punched hole, the hole expansion ratio is greater than 85%, preferably ≥95%, and up to 100% or more; in some embodiments, the hole expansion ratio is from 86% to 110%;

If the original hole is a reamed hole, the hole expansion ratio is greater than 115%, preferably ≥120% and up to 130% or more; in some embodiments, the hole expansion ratio is from 117% to 140%.

4. Bending performance

180° cold bending is qualified at d=0.5a.

The beneficial effects of the present disclosure are:

1. The present disclosure adopts low-cost composition design to reduce the addition of alloying elements, especially precious metal alloying elements, and it is required that [Mn+1.5Cr+5(Ti+Al+Cu)+10(Mo+Ni)+20(Nb+V)] ≤3.0, and (Nb+V+Mo+Ni)<0.03 to ensure extremely low alloying costs for the multiphase steel. Among the common alloying elements of multiphase steel, niobium and vanadium have the highest cost followed by molybdenum and nickel. In consideration of the grade, the unit price of niobium and vanadium can reach 20 times the cost unit price of manganese element; in consideration of the grade, the unit price of molybdenum and nickel can reach 10 times the cost unit price of manganese element. Therefore, this kind of elements is substantively not used in the present disclosure. Other alloying elements, such as titanium, aluminum, manganese, chromium, etc., are selected to minimize the addition amount for the optimized composition design to achieve the lowest overall cost.

2. Due to the low-cost market demand, substantively no precious alloying elements is added in the present disclosure, which easily causes insufficient material strength, such as CN103667948A. In order to increase the strength of the material, fine-grain strengthening combined with Ti element strengthening is mainly adopted in the present disclosure, and a combination of high strength, high elongation, high hole expansion ratio and excellent bending performance is achieved by optimizing the ratio of precipitation strengthening and solid solution strengthening and providing a highly uniform microstructure and sufficiently small inclusions. A certain amount of manganese, chromium, titanium, especially chromium and titanium are still added in the present disclosure. On the one hand, the strengthening is achieved by solid solution of these elements in the matrix, namely, solid solution strengthening; on the other hand, the strengthening is achieved by forming carbide precipitation, namely, second phase strengthening. For these two strengthening mechanisms, the strength enhancement of solid solution strengthening is weaker than that of the second phase strengthening, but the precipitation of carbides will damage the hole-expansion performance of the multiphase steel. Therefore, it is necessary to find a balance between the two strengthening mechanisms, that is, the following relationship is required between the addition of alloying elements and the content of carbon elements: (Mn+2Cr+4Ti+4Nb+4V+4Mo—Si/3+2C)≤3.0. The formula of the present disclosure represents the contribution of each alloying element in the material to the precipitation effect of the second phase. Among them, the abilities of the three types of elements Mn, Cr, Ti (or Nb, Mo, V) to form the carbide precipitation phase increase gradually, so the coefficient design with gradient is adopted; and the Si element has the effect of inhibiting the precipitation of carbides, so it is designed as a negative coefficient in the formula. Therefore, the larger the value of the above formula, the higher the contribution of the alloying elements added to the material to the precipitation strengthening as a whole. It is found in the present disclosure that when the value of the above formula is higher than 3.0, the hole expansion performance of the material will be greatly reduced.

3. Small and highly uniform structure and small-sized inclusions can be realized via the design of composition and process, so as to obtain excellent bending performance. In the design, lower Mn and Cr is adopted firstly to avoid the appearance of large-sized columnar grains in the steel slab after continuous casting, so as to minimize the adverse effects of columnar grains on the subsequent production to obtain a structure with high uniformity. Secondly, a high cooling rate design is adopted in continuous casting. On the one hand, the proportion of columnar crystals in the slab is continuously reduced to increase the proportion of fine equiaxed crystals, and on the other hand, the size of the inclusions generated in the liquid phase (represented by TiN) is reduced. Finally, in the first and second passes of hot rolling, a high-reduction rolling process design is adopted to obtain a fine structure while further destroying the columnar crystals, and achieve a combination of high strength, high bending, and high elongation.

The ultra-high-strength hot-rolled steel plate products, steel strip products and hot-dip galvanized steel plate products manufactured by the present disclosure can be used for the manufacture of automobile chassis and suspension system parts, and at the same time have a combination of low cost, high strength, high hole expansion and good bending performance, thus making up for the blank of low-cost and high-quality chassis steel products urgently needed by the market in the automotive industry chain.

DETAILED DESCRIPTION

Figure 1:
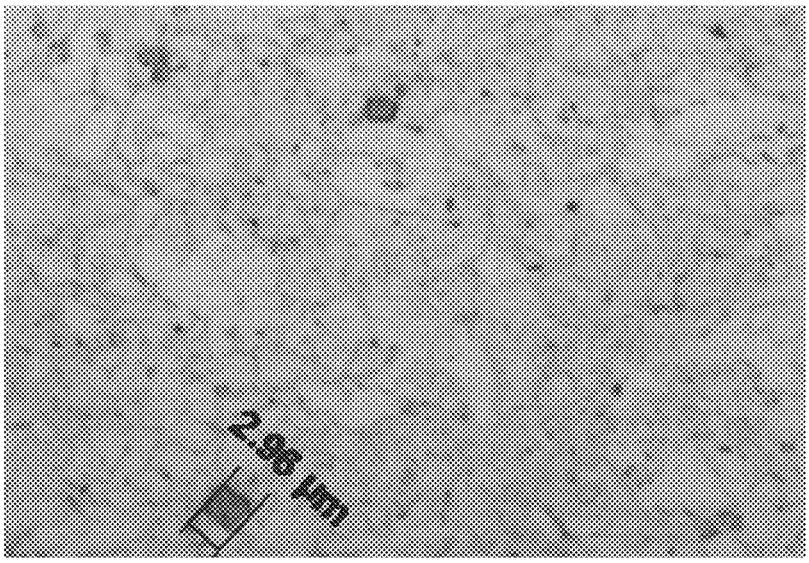
FIG. 1 shows the size of TiN particles when the cooling rate of continuous casting reaches 5° C./s or more and their morphology after hot rolling at large reduction (photograph of the structure in hot rolling state).
Figure 2:
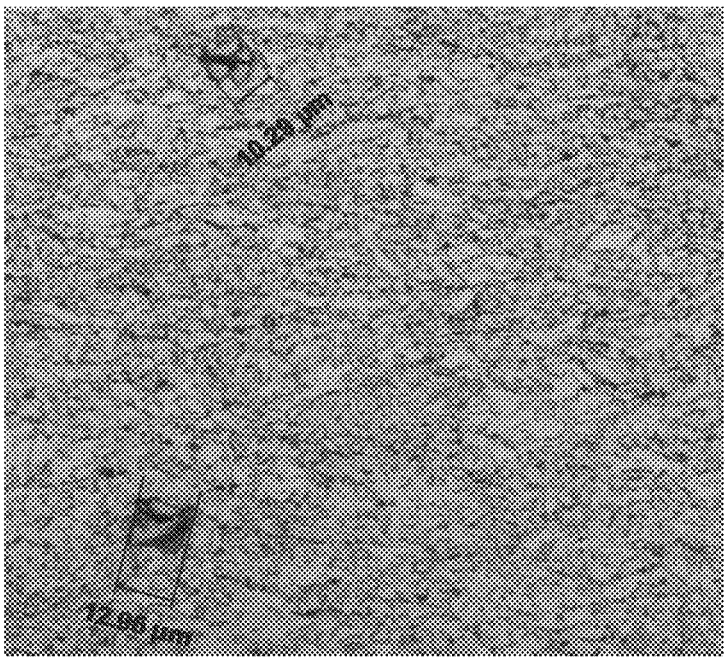
FIG. 2 shows the size of TiN particles when the cooling rate of continuous casting is less than 5° C./s and their morphology after hot rolling at large reduction (photograph of the structure in hot rolling state).
Figure 3:
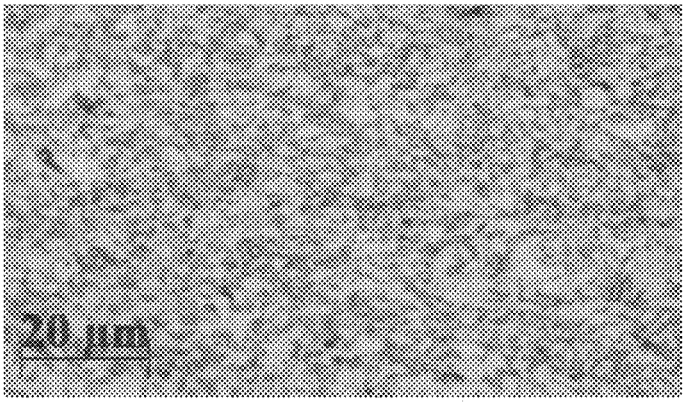
FIG. 3 shows that the microstructure of the steel plate/steel strip of the present disclosure contains ferrite and lower bainite, wherein the content of ferrite+lower bainite is ≥90%.

The present disclosure will be further described with reference to the following examples.

The steels with different compositions after smelting shown in Table 1 were heated and hot rolled according to the process shown in Table 2 to obtain steel plates with a thickness of less than 4 mm. The yield strength, tensile strength and elongation were measured for tensile specimens with a gauge length of 50 mm and 5 mm along the longitudinal direction, and the hole expansion ratio and 180° bending performance were measured in the middle area of the steel plate. The test data are shown in Table 2. Among them, the hole expansion ratio is measured by the hole expansion test. The specimen with a hole in the center was pressed into a concave die with a punch, so that the center hole of the specimen was enlarged until necking or perforated cracks appear at the edge of the hole. Since the preparation method of the original hole in the center of the specimen has a great influence on the test results of the hole expansion ratio, the original holes in the center of the specimens were prepared by punching and reaming, respectively and subsequent tests were performed in accordance with the hole expansion ratio test method specified in the ISO/DIS 16630 standard. The 180° bending test was performed using the method for the determination of bending properties in the GB/T232-2010 standard.

In Table 1, Examples A-I are the steels of the present disclosure. The content of carbon or manganese or other alloying elements in Comparative Examples J-N exceeds the scope of the composition of the present disclosure. M in the Table refers to the calculated value of Item [Mn+1.5Cr+5(Ti+Al+Cu)+10(Mo+Ni)+20(Nb+V)], R refers to the calculated value of Item (Mn+2Cr+4Ti+4V+4Nb+4Mo—Si/3+2C) in the composition. In addition, Comparative Example O and Comparative Example P are Examples disclosed in CN101906567A and CN101285156A, respectively. It can be seen from the comparison that the M and R values of Comparative Example O and Comparative Example P all exceed the range of the present disclosure, indicating that the alloy cost of these two comparative examples is higher than that of the case of the present disclosure, and the optimized alloy ratio according to the formula designed in the present invention is not adopted.

Table 2 shows the different manufacturing processes of various steel grades in Table 1, which are also divided into two categories of Examples and Comparative Examples, wherein the processes of Comparative Example O and Comparative Example P are the manufacturing processes disclosed in the corresponding patent applications. Table 3 shows the detected values for mechanical properties of the above-mentioned examples and comparative examples, wherein the properties of Comparative Example O and Comparative Example P are those disclosed in the corresponding patent applications. It can be seen from the table that the properties of Comparative Example O and Comparative Example P are inferior to those of the examples in the present disclosure.

It can be seen that when C, Mn, Ti and other alloying components deviate from the scope of the present invention, for example, when the content of Mn and Ti is low, such as Comparative Examples K and M, the strength of the steel plate is lower than the design requirements; and when the content of C, Ti or the R value is higher than the composition range of the present disclosure, such as Comparative examples J, L and N, the excessive content of C and Mn leads to the production of a large amount of martensite in the structure, which deteriorates the hole expansion and bending properties of the material, while if the content of Ti and the value of R is too high, the carbides in the structure are coarsened, and the hole expansion performance of the material is deteriorated, which is not in line with the purpose of the present disclosure.

When the temperature of the slab entering the furnace is too low, such as Comparative Steel A-2, the strength does not meet the design standards of the present disclosure; if the coiling temperature is too low, such as Comparative Example D-2, the precipitation of carbides in the steel is inhibited, resulting in too low strength of the steel plate. When the reduction rate of the first two passes of hot rolling is not sufficient, the banded structure of the steel plate cannot be completely eliminated, and the grains cannot be fully refined to achieve the uniformity of the structure, which leads to the deterioration of the bending performance of the steel plate for elongation, such as Comparative Example B-2. When the cooling rate of continuous casting is not sufficient, but a large reduction rate is pursued in hot rolling, the coarse TiN particles in the steel are broken and a potential crack source is formed, which greatly deteriorates the elongation, hole expansion performance and bending performance of the material, such as Comparative Example C-2.

Based on the above, the present disclosure greatly reduces alloying costs by controlling a reasonable composition range, limiting the content of alloying elements and optimizing the ratio of each element on the basis of carbon-manganese steel. By further controlling the cooling rate in continuous casting, the hot rolling reduction rate, and the coiling temperature on the basis of the conventional automobile steel production line, the present disclosure produces a low-cost ultra-high-strength hot-rolled steel plate/steel strip with high strength, high hole expansion performance and excellent bending performance, which has a yield strength of not less than 680 MPa, a tensile strength of not less than 780 MPa, and a hole expansion ratio of not less than 85% (the original hole is punched) or not less than 115% (the original hole is reamed), 180° bending d=0.5a, to make up for the urgent demand of the automotive industry market for chassis and suspension materials with a combination of low cost, high strength and high forming performance.

TABLE 1

(unit: percentage)

| Steel No. | C | Si | Mn | P | S | Al | Cr | Ti | V | Mo | Ni | Cu | Nb | M | R |
|---|---|---|---|---|---|---|---|---|---|---|---|---|---|---|---|
| Example A | 0.058 | 0.30 | 1.55 | 0.012 | 0.002 | 0.02 | 0.43 | 0.090 | 0 | 0 | 0 | 0 | 0 | 2.75 | 2.79 |
| Example B | 0.040 | 0.48 | 1.79 | 0.013 | 0.004 | 0.01 | 0.38 | 0.110 | 0 | 0 | 0 | 0 | 0 | 2.96 | 2.91 |
| Example C | 0.068 | 0.25 | 1.32 | 0.015 | 0.003 | 0.02 | 0.40 | 0.130 | 0 | 0 | 0 | 0 | 0.01 | 2.87 | 2.73 |
| Example D | 0.053 | 0.36 | 1.85 | 0.014 | 0.002 | 0.04 | 0.29 | 0.071 | 0 | 0 | 0 | 0 | 0 | 2.84 | 2.70 |
| Example E | 0.046 | 0.14 | 1.49 | 0.010 | 0.001 | 0.01 | 0.49 | 0.077 | 0 | 0 | 0 | 0 | 0 | 2.66 | 2.82 |
| Example F | 0.035 | 0.43 | 1.37 | 0.008 | 0.005 | 0.03 | 0.33 | 0.101 | 0 | 0 | 0 | 0 | 0.02 | 2.92 | 2.440666667 |
| Example G | 0.062 | 0.21 | 1.72 | 0.007 | 0.006 | 0.01 | 0.25 | 0.140 | 0 | 0 | 0 | 0 | 0 | 2.85 | 2.838 |
| Example H | 0.038 | 0.39 | 1.65 | 0.014 | 0.004 | 0.01 | 0.35 | 0.135 | 0 | 0 | 0 | 0 | 0 | 2.90 | 2.836 |
| Example I | 0.049 | 0.17 | 1.42 | 0.013 | 0.001 | 0.05 | 0.46 | 0.120 | 0 | 0 | 0 | 0 | 0 | 2.96 | 2.861333333 |
| Comparative Example J | 0.072 | 0.23 | 1.75 | 0.012 | 0.002 | 0.03 | 0.40 | 0.085 | 0 | 0 | 0 | 0 | 0 | 2.93 | 2.96 |
| Comparative Example K | 0.052 | 0.47 | 1.28 | 0.015 | 0.001 | 0.04 | 0.42 | 0.102 | 0 | 0 | 0 | 0 | 0.01 | 2.82 | 2.52 |
| Comparative Example L | 0.056 | 0.20 | 1.42 | 0.01 | 0.001 | 0.03 | 0.45 | 0.148 | 0 | 0 | 0 | 0 | 0 | 2.99 | 2.96 |
| Comparative Example M | 0.042 | 0.29 | 1.59 | 0.01 | 0.002 | 0.03 | 0.47 | 0.067 | 0 | 0 | 0 | 0 | 0 | 2.78 | 2.79 |
| Comparative Example N | 0.049 | 0.16 | 1.56 | 0.01 | 0.001 | 0.01 | 0.48 | 0.132 | 0 | 0 | 0 | 0 | 0 | 2.99 | 3.09 |

TABLE 1-continued (unit: percentage)

| Steel No. | C | Si | Mn | P | S | Al | Cr | Ti | V | Mo | Ni | Cu | Nb | M | R |
|---|---|---|---|---|---|---|---|---|---|---|---|---|---|---|---|
| Comparative Example O | 0.085 | 0.18 | 1.45 | 0.015 | 0.002 | 0.042 | 0.03 | 0.162 | 0 | 0.21 | 0.01 | 0 | 0.051 | 5.735 | 3.315 |
| Comparative Example P | 0.07 | 0.1 | 1.85 | 0.02 | 0.01 | Not disclosed | 0.80 | 0.12 | 0 | 0 | 0 | 0 | 0 | 3.65 | 4.04 |

TABLE 2

| Steel No. | Continuous cast cooling rate ° C./s | Temperature of slab entering into furnace in hot rolling ° C. | Reheating temperature ° C. | Reduction rate of the first pass % | Reduction rate of the second pass % | Finish rolling temperature ° C. | Coiling temperature ° C. |
|---|---|---|---|---|---|---|---|
| Example A-1 | 10 | 720 | 1190 | 55 | 57 | 900 | 600 |
| Com. Example A-2 | 10 | 620 | 1220 | 55 | 55 | 890 | 600 |
| Example B-1 | 15 | 800 | 1210 | 58 | 56 | 890 | 615 |
| Com. Example B-2 | 10 | 780 | 1220 | 45 | 40 | 880 | 610 |
| Example C-1 | 12 | 810 | 1200 | 59 | 59 | 880 | 630 |
| Com. Example C-2 | 1 | 780 | 1225 | 57 | 57 | 890 | 600 |
| Example D-1 | 17 | 750 | 1230 | 65 | 60 | 870 | 605 |
| Com. Example D-2 | 10 | 850 | 1240 | 58 | 58 | 910 | 520 |
| Example E | 13 | 830 | 1225 | 63 | 61 | 920 | 560 |
| Example F | 14 | 790 | 1220 | 62 | 62 | 930 | 575 |
| Example G | 16 | 850 | 1245 | 64 | 59 | 945 | 595 |
| Example H | 9 | 710 | 1160 | 56 | 56 | 855 | 580 |
| Example I | 11 | 770 | 1170 | 58 | 58 | 865 | 585 |
| Com. Example M | 15 | 730 | 1210 | 58 | 57 | 900 | 610 |
| Com. Example N | 15 | 720 | 1210 | 55 | 55 | 890 | 580 |
| Com. Example J | 15 | 760 | 1220 | 57 | 55 | 900 | 610 |
| Com. Example K | 10 | 720 | 1230 | 55 | 57 | 890 | 610 |
| Com. Example L | 10 | 710 | 1230 | 56 | 55 | 900 | 600 |
| Com. Example O | Not disclosed | Not disclosed | >1150 | Not disclosed | Not disclosed | 900 | 525 |
| Com. Example P | Not disclosed | 1000° C. | 1180 | Not disclosed | Not disclosed | 930 | 640 |

TABLE 3

| Steel No. | Yield strength, MPa | Tensile strength, MPa | A50% | A5% | Hole expansion ratio (punched hole), % | Hole expansion ratio (reamed hole), % | 180° bending (d = 0.5a) |
|---|---|---|---|---|---|---|---|
| Example A-1 | 762 | 843 | 17.3 | 21.2 | 99 | 123 | qualified |
| Comparative Example A-2 | 652 | 743 | 16.2 | 19.5 | 101 | 126 | qualified |
| Example B-1 | 737 | 822 | 18.4 | 23.1 | 105 | 136 | qualified |
| Comparative Example B-2 | 725 | 823 | 15.8 | 19.6 | 85 | 115 | cracked |
| Example C-1 | 803 | 830 | 15.2 | 19.1 | 99 | 123 | qualified |
| Comparative Example C-2 | 681 | 811 | 11.1 | 14.3 | 70 | 83 | cracked |
| Example D-1 | 818 | 873 | 15.3 | 19.1 | 92 | 118 | qualified |
| Comparative Example D-2 | 636 | 731 | 12.7 | 16.5 | 112 | 139 | qualified |
| Example E | 712 | 785 | 20.7 | 24.3 | 103 | 132 | qualified |
| Example F | 724 | 805 | 18.5 | 25.0 | 108 | 139 | qualified |
| Example G | 829 | 899 | 15.1 | 19.2 | 86 | 117 | qualified |
| Example H | 749 | 815 | 16.3 | 20.7 | 89 | 120 | qualified |
| Example I | 772 | 833 | 16.0 | 20.5 | 91 | 122 | qualified |
| Comparative Example J | 853 | 916 | 7.0 | 10.0 | 72 | 85 | cracked |
| Comparative Example K | 601 | 727 | 20.2 | 24.5 | 112 | 139 | qualified |
| Comparative Example L | 805 | 853 | 15.3 | 19.4 | 70 | 87 | cracked |
| Comparative Example M | 636 | 731 | 24.7 | 29.6 | 112 | 139 | qualified |
| Comparative Example N | 798 | 832 | 16.1 | 20.2 | 76 | 101 | qualified |
| Comparative Example O | 698 | 803 | 18.0 | Not disclosed | 79 | Not disclosed | Not disclosed |
| Comparative Example P | 755-800 | 780-885 | Not disclosed | 17-23 | Not disclosed | Not disclosed | 180° bending d = a |

What is claimed is:

1. An ultra-high strength multiphase steel plate/steel strip, comprising the following chemical elements by weight percentage: C: 0.03-0.07%, Si: 0.1-0.5%, Mn: 1.3-1.9%, P≤0.02%, S≤0.01%, Al: 0.01-0.05%, Cr: 0.2-0.5%, Ti: 0.07-0.14%, (Ni+Nb+Mo+V)<0.03%, and a balance of Fe and unavoidable impurities; at the same time, it is required to satisfy:

$$[Mn+1.5Cr+5(Ti+Al+Cu)+10(Mo+Ni)+20(Nb+V)] \leq 3.0;$$

(Mn+2Cr+4Ti+4Nb+4V+4Mo—Si/3+2C)≤3.0; and wherein the steel plate/steel strip has a tensile strength of ≥780 MPa, a yield strength of ≥680 MPa, an elongation of ≥15%, and a hole expansion ratio performance index which satisfies: if the original hole is a punched hole, the hole expansion ratio is ≥85%; if the original hole is a reamed hole, the hole expansion ratio is ≥115%; and a bending performance which satisfies 180° bending is qualified at d=0.5a, and wherein d is bending angle diameter and a is thickness of plate.

2. The ultra-high strength multiphase steel plate/steel strip according to claim 1, wherein the C content is 0.04-0.06%, in weight percentage.

3. The ultra-high strength multiphase steel plate/steel strip according to claim 1, wherein the Si content is 0.1-0.27%, in weight percentage.

4. The ultra-high strength multiphase steel plate/steel strip according to claim 1, wherein the Mn content is 1.45-1.75%, in weight percentage.

5. The ultra-high strength multiphase steel plate/steel strip according to claim 1, wherein the Cr content is 0.35-0.50%, in weight percentage.

6. The ultra-high strength multiphase steel plate/steel strip according to claim 1, wherein chemical elements Nb+Mo+V<0.03%, in weight percentage.

7. The ultra-high strength multiphase steel plate/steel strip according to claim 1, wherein the steel has a structure containing ferrite, lower bainite, and further containing carbide precipitation phase, inclusion phase and/or trace martensite phase, wherein the content of ferrite is ≤70% by area, and the content of ferrite+lower bainite is ≥90% by area.

8. The ultra-high strength multiphase steel plate/steel strip according to claim 7, wherein the microstructure of the steel plate/steel strip further comprises TiN particles, and a single particle has the longest side length of <10 μm or an area of <50 $\mu m^2$.

9. The ultra-high strength multiphase steel plate/steel strip according to claim 7, wherein the average diameter of ferrite grains is <6 μm, or a grain size ASTM rating of ferrite is >11.8.

10. The ultra-high strength multiphase steel plate/steel strip according to claim 1, wherein the steel plate/steel strip has a yield ratio of ≥0.9.

11. A manufacturing method for the ultra-high strength multiphase steel plate/steel strip according to claim 1 comprising the following steps:

1) Smelting, continuous casting wherein the chemical elements according to claim 1 is smelt and cast into a casting slab by continuous casting, wherein a cooling rate of the slab is ≥5° C./s during continuous casting;

2) Hot entering, rolling, cooling after rolling and coiling of the slab wherein the slab enters the furnace at a temperature of not less than 700° C., and the slab is heated at a heating temperature of 1100-1250° C.; wherein each reduction rate for a first two passes of hot rolling is ≥55%, and a final rolling temperature of finish rolling is 850-950° C.; and the coiling temperature is 550-630° C.; and 3) Pickling.

12. The manufacturing method for the ultra-high strength multiphase steel plate/steel strip according to claim 11, wherein after step 3) pickling, the method further comprises hot dip galvanizing annealing process to obtain a finished hot-rolled hot-dip galvanized steel plate.

13. The manufacturing method for the ultra-high strength multiphase steel plate/steel strip according to claim 11, wherein in step 1), a proportion of columnar crystals in the slab casting structure is ≤10% by area, or a thickness of the columnar crystal region is <40 mm.

14. The manufacturing method for the ultra-high strength multiphase steel plate/steel strip according to claim 11, wherein a thickness of the steel plate/steel strip is 0.7-4.0 mm.

15. The manufacturing method for the ultra-high strength multiphase steel plate/steel strip according to claim 11, wherein the C content of the steel plate/steel strip is 0.04-0.06%, in weight percentage, the Si content of the steel plate/steel strip is 0.1-0.27%, in weight percentage, the Mn content of the steel plate/steel strip is 1.45-1.75%, in weight percentage, or the Cr content of the steel plate/steel strip is 0.35-0.50%, in weight percentage.

16. The manufacturing method for the ultra-high strength multiphase steel plate/steel strip according to claim 11, wherein the steel has a structure containing ferrite, lower bainite, and further containing carbide precipitation phase, inclusion phase and/or trace martensite phase, wherein the content of ferrite is ≤70% by area, and the content of ferrite+lower bainite is ≥90% by area.

17. The manufacturing method for the ultra-high strength multiphase steel plate/steel strip according to claim 16, wherein the microstructure of the steel plate/steel strip further comprises TiN particles, and a single particle has the longest side length of <10 μm or an area of <50 $\mu m^2$.

18. The manufacturing method for the ultra-high strength multiphase steel plate/steel strip according to claim 16, wherein the average diameter of ferrite grains is <6 μm, or a grain size ASTM rating of ferrite is >11.8.

19. The manufacturing method for the ultra-high strength multiphase steel plate/steel strip according to claim 16, wherein the steel plate/steel strip has a tensile strength of ≥780 MPa, a yield strength of ≥680 MPa, a yield ratio of ≥0.9, and an elongation of ≥15%, and a hole expansion ratio performance index which satisfies: if the original hole is a punched hole, the hole expansion ratio is ≥85%; if the original hole is a reamed hole, the hole expansion ratio is ≥115%; and a bending performance which satisfies 180° bending is qualified at d=0.5a.

* * * * *